US012240722B2

(12) United States Patent
Fujikura et al.

(10) Patent No.: US 12,240,722 B2
(45) Date of Patent: Mar. 4, 2025

(54) FEEDING DEVICE AND IMAGE FORMING APPARATUS

(71) Applicant: FUJIFILM Business Innovation Corp., Tokyo (JP)

(72) Inventors: Hiroaki Fujikura, Kanagawa (JP); Yoshiyuki Kitazawa, Kanagawa (JP); Yohei Onoue, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 112 days.

(21) Appl. No.: 17/949,699

(22) Filed: Sep. 21, 2022

(65) Prior Publication Data

US 2023/0303347 A1 Sep. 28, 2023

(30) Foreign Application Priority Data

Mar. 28, 2022 (JP) ..... 2022-052246

(51) Int. Cl.
*B65H 3/08* (2006.01)
*B65H 7/14* (2006.01)
*B65H 7/16* (2006.01)

(52) U.S. Cl.
CPC ..... *B65H 3/08* (2013.01); *B65H 7/14* (2013.01); *B65H 7/16* (2013.01); *B65H 2511/22* (2013.01); *B65H 2553/42* (2013.01); *B65H 2801/03* (2013.01)

(58) Field of Classification Search
CPC ... B65H 3/08; B65H 7/14; B65H 7/16; B65H 2511/22; B65H 2553/42; B65H 2801/03
See application file for complete search history.

(56) References Cited

U.S. PATENT DOCUMENTS

| | | | | |
|---|---|---|---|---|
| 9,199,810 | B2 | 12/2015 | Shimoyama et al. | |
| 2014/0265105 | A1* | 9/2014 | Shimoyama | B65H 3/48 271/12 |
| 2015/0021848 | A1* | 1/2015 | Mizuno | B65H 3/48 271/12 |
| 2019/0202647 | A1* | 7/2019 | Sugawara | B65H 1/14 |

FOREIGN PATENT DOCUMENTS

JP 2015-24868 A 2/2015

* cited by examiner

*Primary Examiner* — Thomas A Morrison
(74) *Attorney, Agent, or Firm* — Oliff PLC

(57) ABSTRACT

A feeding device includes: a supply unit that supplies air into space between plural media loaded to float the media; a feeder that adsorbs the media floated by the supply unit and feeds the media; a separator that supplies air to a second medium disposed immediately below a first medium adsorbed by the feeder to separate the second medium from the first medium; a detector that detects a position of at least one of the first medium and the second medium after air is supplied by the separator; and a modifier that modifies a condition related to a feeding operation of the feeder based a position detected by the detector.

5 Claims, 7 Drawing Sheets

FEEDING DEVICE AND IMAGE FORMING APPARATUS

CROSS-REFERENCE TO RELATED APPLICATIONS

This application is based on and claims priority under 35 USC 119 from Japanese Patent Application No. 2022-052246 filed Mar. 28, 2022.

BACKGROUND

(i) Technical Field

The present disclosure relates to a feeding device and an image forming apparatus.

(ii) Related Art

Japanese Unexamined Patent Application Publication No. 2015-24868 discloses a sheet feeding apparatus including: a placement unit on which a sheet bundle is placeable in which multiple sheets are vertically stacked; an air blow unit that blows air to the sheet bundle placed on the placement unit to float at least the uppermost sheet; an adsorption and transportation unit that is provided above the placement unit and adsorbs the uppermost sheet floated by the air blow unit to transport the sheet in a predetermined transport direction; a first light source that emits first slit light having components extending vertically and crossing at least a first edge of a first sheet and a second edge of a second sheet below the first sheet among multiple sheets floated; an image capture unit that captures the first slit light radiated to the first sheet and the second sheet, and has an image capture direction in a plane parallel to the first sheet and the second sheet, the image capture direction being different from an emission direction of the first slit light emitted by the first light source; a calculation unit that calculates a vertical interval between the first sheet and the second sheet based on the first slit light captured by the image capture unit; and an air volume adjustment unit that adjusts an air volume based on the vertical interval between the first sheet and the second sheet calculated by the calculation unit.

SUMMARY

A feeding device that feeds a medium may include: a supply unit that supplies air into space between a plurality of media loaded to float the media; a feeder that adsorbs the media floated by the supply unit and feeds the media; and a separator that supplies air to a second medium disposed immediately below a first medium adsorbed by the feeder to separate the second medium from the first medium.

In the case where the position of at least one of the first medium and the second medium is detected, and the condition related to the feeding operation of the feeder is modified based on the detected position in the feeding device, when the position is detected before air is supplied by the separator, the position may vary due to the air supply by the separator, and the detected position and the actual position may differ.

Aspects of non-limiting embodiments of the present disclosure relate to increasing the accuracy of detection of the position, as compared to when the position of at least one of the first medium and the second medium is detected by the detector before air is supplied by the separator.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a feeding device including: a supply unit that supplies air into space between a plurality of media loaded to float the media; a feeder that adsorbs the media floated by the supply unit and feeds the media; a separator that supplies air to a second medium disposed immediately below a first medium adsorbed by the feeder to separate the second medium from the first medium; a detector that detects a position of at least one of the first medium and the second medium after air is supplied by the separator; and a modifier that modifies a condition related to a feeding operation of the feeder based a position detected by the detector.

BRIEF DESCRIPTION OF THE DRAWINGS

Exemplary embodiment of the present disclosure will be described in detail based on the following figures, wherein.

DETAILED DESCRIPTION

Hereinafter, an example of an exemplary embodiment according to the present disclosure will be described with reference to the drawings.

(Image Forming Apparatus 10)

Figure 1:
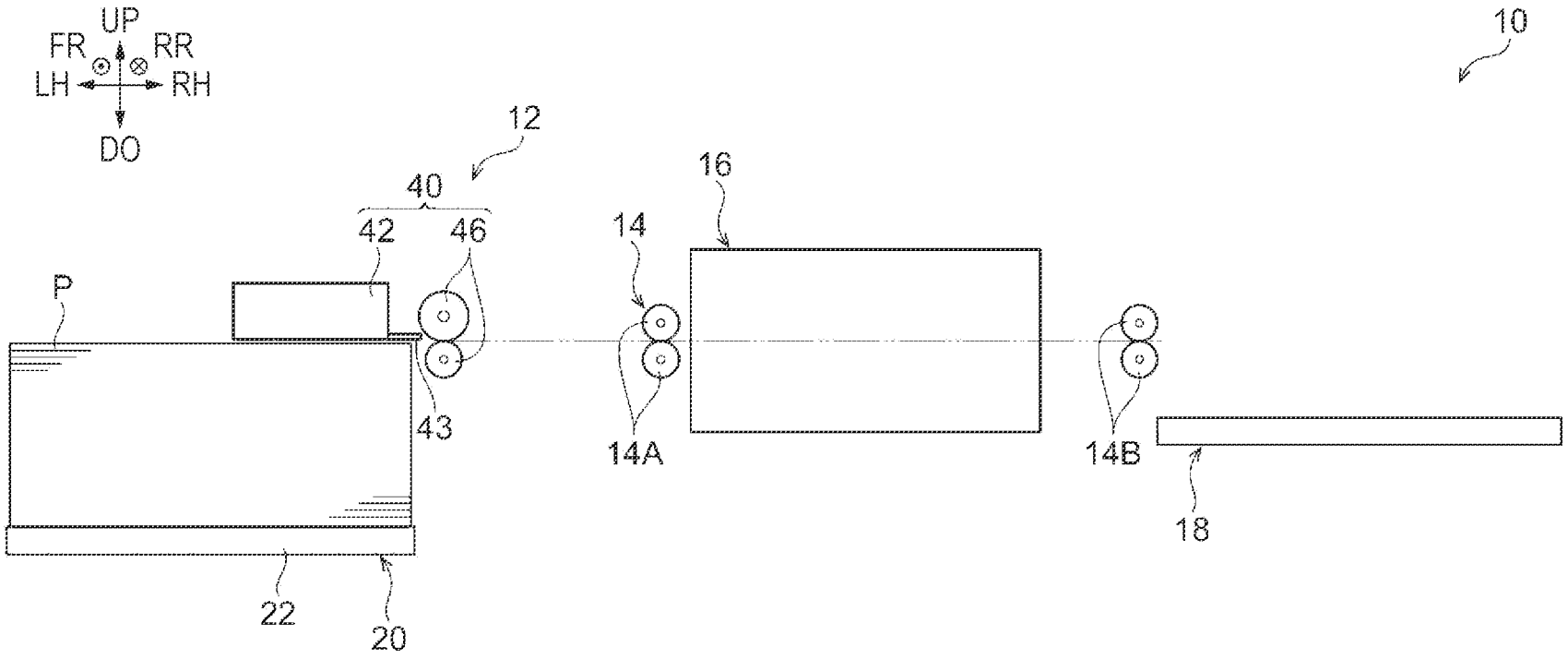
FIG. 1 is a schematic view illustrating an image forming apparatus according to an exemplary embodiment.

First, the configuration of an image forming apparatus 10 according to the exemplary embodiment will be described. FIG. 1 is a schematic view illustrating the image forming apparatus according to the exemplary embodiment.

Note that an arrow UP in the drawings indicates the upward direction (specifically, vertical upward) of the apparatus, and an arrow DO indicates the downward direction (specifically, vertical downward) of the apparatus. In addition, an arrow LH in the drawings indicates the leftward direction of the apparatus, and an arrow RH indicates the rightward direction of the apparatus. Also, an arrow FR in the drawings indicates the forward direction of the apparatus, and an arrow RR indicates the rearward direction of the apparatus. These directions are defined for convenience of description, thus the configuration of the apparatus is not restricted by the directions. In each direction of the apparatus, the word "apparatus" may be omitted in some cases. Specifically, for example, "the upward direction of the apparatus" may be simply referred to as "the upward direction".

Also, in the description below, "the upward-downward direction" may be used in the sense of "both upward and downward directions" or "either one of the upward and downward directions". "The rightward-leftward direction" may be used in the sense of "both rightward and leftward directions" or "either one of the rightward and leftward directions". "The rightward-leftward direction" may be referred to as the cross direction, the lateral direction, and the horizontal direction. "The forward-rearward direction" may be used in the sense of "both forward and rearward directions" or "either one of the forward and rearward directions". "The forward-rearward direction" may be referred to as the cross direction, the lateral direction, and the horizontal direction. The upward-downward direction, the rightward-leftward direction, the forward-rearward direction are directions perpendicular to each other (specifically, orthogonal directions).

The symbol "○" with "x" inside thereof indicates an arrow pointing from the near side to the far side of the paper surface. Also, the symbol "○" with "." inside thereof indicates an arrow pointing from the far side to the near side of the paper surface.

The image forming apparatus 10 illustrated in FIG. 1 is an apparatus that forms an image on a recording medium P as an example of a medium. Specifically, as illustrated in FIG. 1, the image forming apparatus 10 includes a feeding device 12, a transporter 14, an image former 16, and a discharger 18. Hereinafter, each component of the image forming apparatus 10 will be described.

(Transporter 14)

The transporter 14 illustrated in FIG. 1 is a component unit that transports a recording medium P in the image forming apparatus 10. The transporter 14 has a function of transporting a recording medium P fed from the feeding device 12 to the image former 16, and a function of transporting a recording medium P with an image formed by the image former 16 to the discharger 18.

Specifically, the transporter 14 has transport members 14A, 14B each configurated by a pair of transport rollers. In the transporter 14, the transport member 14A transports a recording medium P fed from the feeding device 12 to the image former 16, and the transport member 14B transports a recording medium P with an image formed by the image former 16 to the discharger 18.

Note that the transport members 14A, 14B are not limited to a pair of transport rollers. The transport members 14A, 14B each may be a transport member such as a transport belt or a transport drum, and it is possible to use various types of transport members.

(Image Former 16)

The image former 16 illustrated in FIG. 1 is a component unit that forms an image of a recording medium P fed from the feeding device 12. As the image former 16, for example, an ink jet image former that forms an image on a recording medium using ink, and an electrophotographic image former that forms an image on a recording medium using toner may be used.

In an ink jet image former, an image is formed on a recording medium, for example, by discharging ink drops from a discharge unit to the recording medium. In an ink jet image former, an image may be formed on a recording medium, for example, by discharging ink drops from a discharge unit to a transfer body, then transferring the ink drops from the transfer body to the recording medium.

An electrophotographic image former forms an image on a recording medium by performing, for example, the processes of charging, exposure, developing, and transfer. An electrophotographic image former may form an image on a recording medium by performing the processes of charging, exposure, developing, transfer to form an image on a transfer body, and transferring the image from the transfer body to the recording medium.

Examples of image former are not limited to the above-mentioned ink jet image former and the above-mentioned electrophotographic image former, and it is possible to use various image formers.

(Discharger 18)

The discharger 18 illustrated in FIG. 1 is a section to which a recording medium with an image formed is discharged, in the image forming apparatus 10. After an image is formed by the image former 16, a recording medium P transported by the transporter 14 (specifically, the transport member 14B) is discharged to the discharger 18.

(Feeding Device 12)

Figure 2:
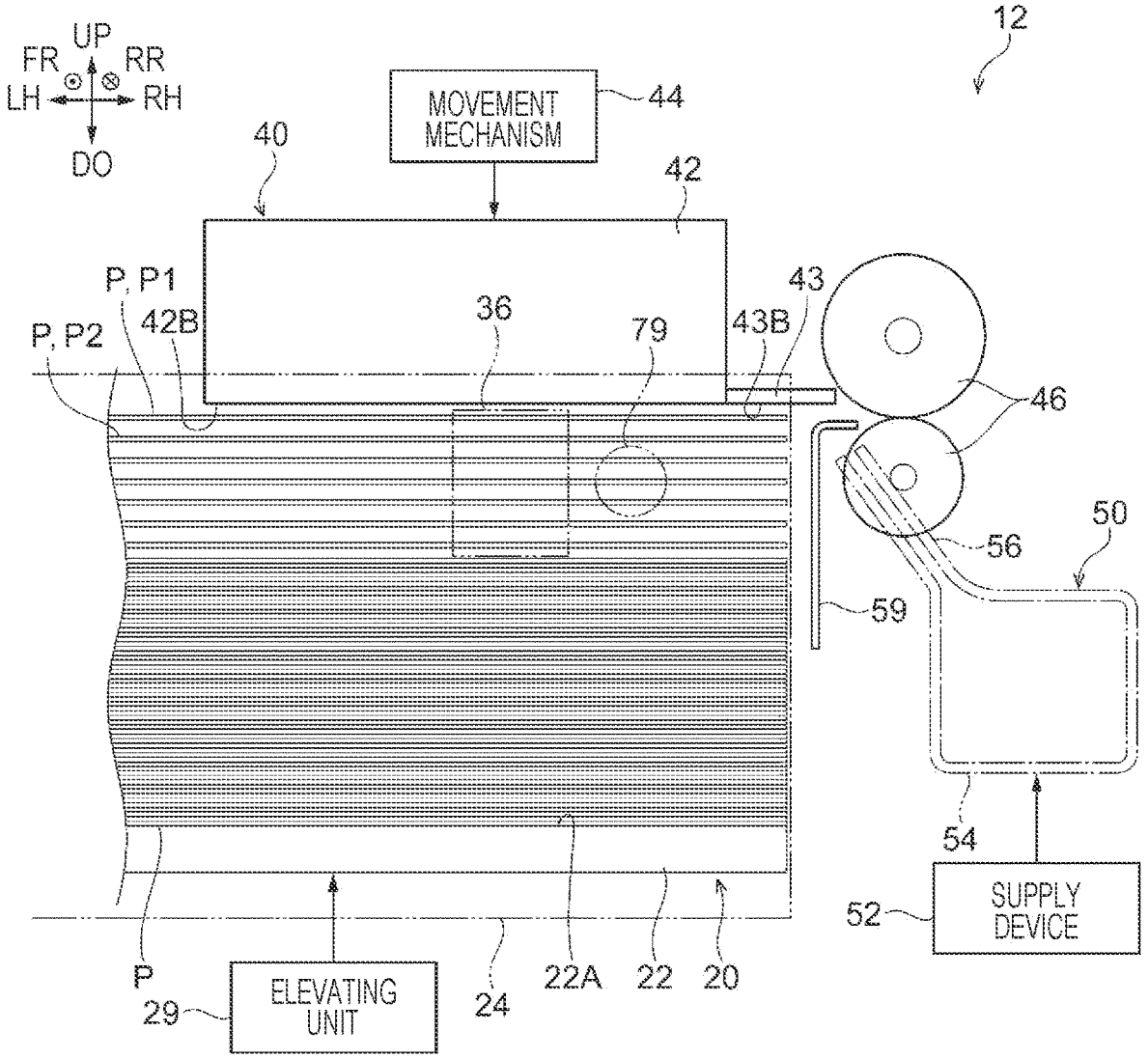
FIG. 2 is a schematic view illustrating a feeding device according to the exemplary embodiment.
Figure 3:
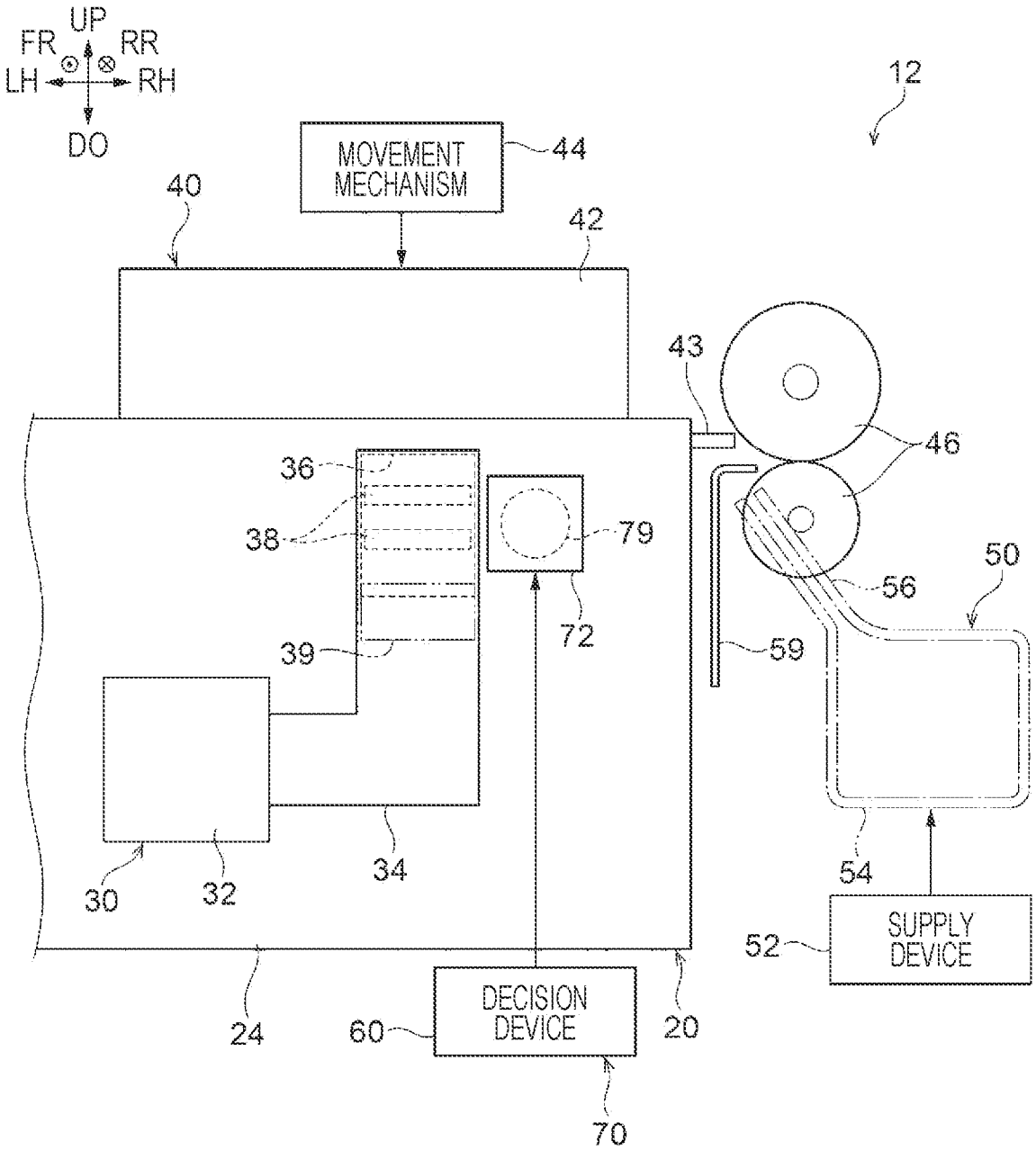
FIG. 3 is a view from the outer side of a side wall of the feeding device according to the exemplary embodiment.

The feeding device 12 illustrated in FIGS. 1, 2 and 3 is a device that feeds a recording medium P. In the exemplary embodiment, the feeding device 12 feeds a recording medium P in a predetermined feed direction (specifically, the rightward direction). Therefore, in the feeding device 12, the rightward direction is downstream in the feed direction, and the leftward direction is upstream in the feed direction. In a recording medium P fed by the feeding device 12, a downstream end in the feed direction is referred to as a front end, and an upstream end in the feed direction is referred to as a rear end. In the recording medium P, a direction intersecting the feed direction (specifically, the forward-rearward direction) is referred to as a width direction, and an end in the width direction is referred to as a lateral end.

Specifically, as illustrated in FIGS. 2 and 3, the feeding device 12 includes a storage 20, an elevating unit 29 (see FIG. 2), a supply unit 30 (see FIG. 3), a feeder 40, a separator 50, a restrictor 59, and a detector 70 (see FIG. 3). Hereinafter, each unit of the feeding device 12 will be described.

(Storage 20 and Elevating Unit 29)

The storage 20 is a component unit that stores recording media P. Specifically, as illustrated in FIG. 2, the storage 20 has a loading unit 22, and a pair of side walls 24. In FIG. 2, a side wall 24 of one of the pair of side walls 24 (specifically, on the forward side) is illustrated.

The loading unit 22 is a component unit on which recording media P are loaded. Specifically, the loading unit 22 constitutes the bottom of the storage 20, and is configurated by a loading plate (so-called a bottom plate) in which recording media P are loaded on an upper surface 22A.

The pair of side walls 24 are respectively disposed on the front side and the rear side with respect to the recording media P loaded on the loading unit 22. Each of the pair of side walls 24 is opposed to a corresponding one of a pair of lateral ends in the recording media P loaded on the loading unit 22, and configured to position the recording media P in the width direction (in other words, in the forward-rearward direction).

The storage 20 has a positioning unit (not illustrated) that positions the rear end of the recording media P loaded on the loading unit 22. The storage 20 is not limited to the above-mentioned configuration, and it is possible to use various configurations.

The elevating unit 29 is a component unit that elevates the recording media P stored in the storage 20. Specifically, the elevating unit 29 elevates the recording medium P to position the uppermost recording medium P at a predetermined height (hereinafter referred to as a feed height) by elevating the loading unit 22, and lowers the recording media P by lowering the loading unit 22.

As the elevating unit 29, for example, a pulling member such as a wire and a push-up member such as an arm may be used. The pulling member elevates the recording media P, for example, by pulling the loading unit 22 upward, and lowers the recording media P by the self-weight of the recording media P and the loading unit 22. The push-up member elevates the recording media P, for example, by pushing the loading unit 22 upward from the lower side of the loading unit 22, and lowers the recording media P by the self-weight of the recording media P and the loading unit 22. The elevating unit 29 is not limited to the above-mentioned configuration, and it is possible to use various configurations.

(Supply Unit 30)

Figure 4:
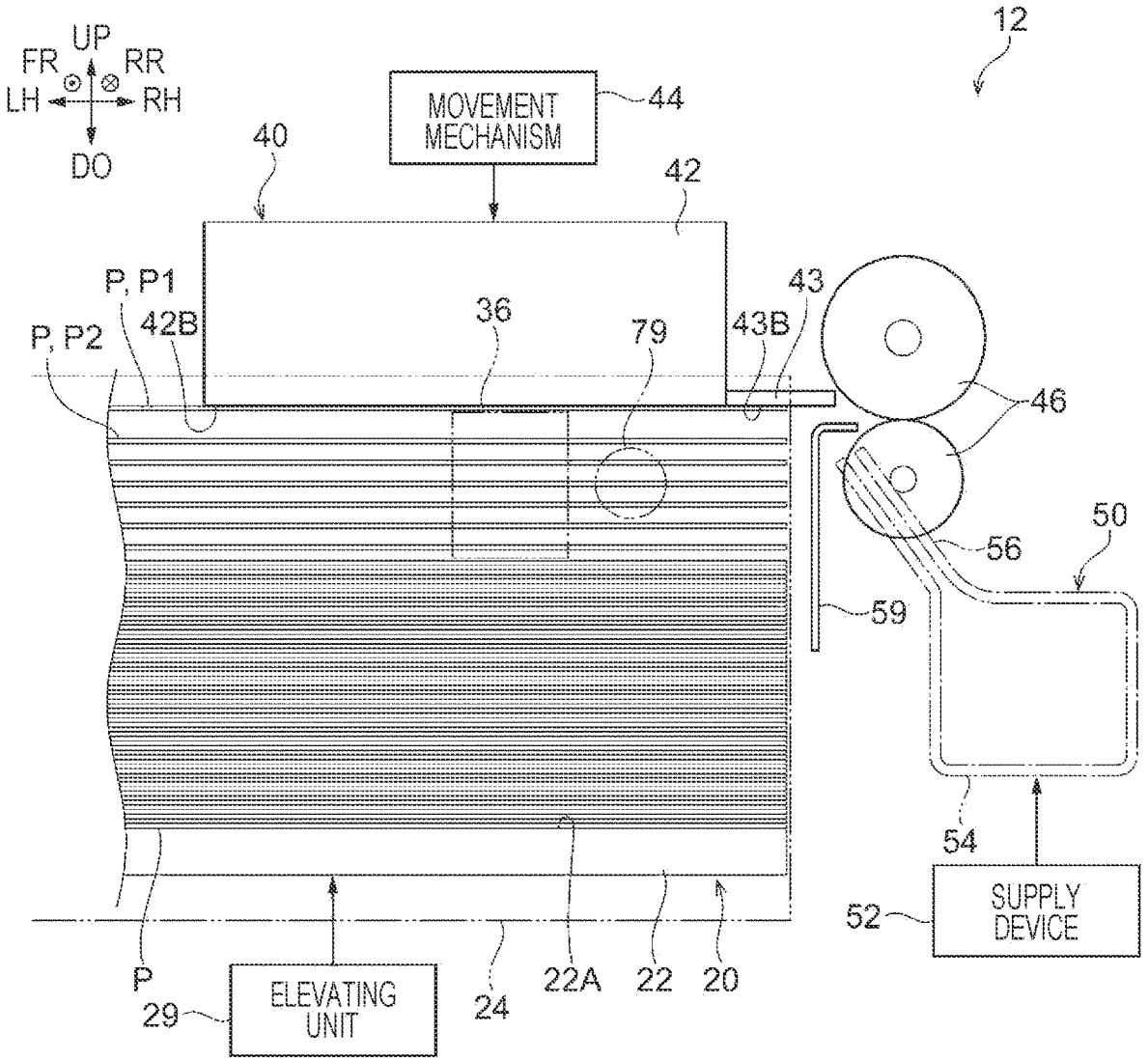
FIG. 4 is a schematic view illustrating a state in which an adsorption body adsorbs an uppermost recording medium in the feeding device illustrated in FIG. 2.
Figure 5:
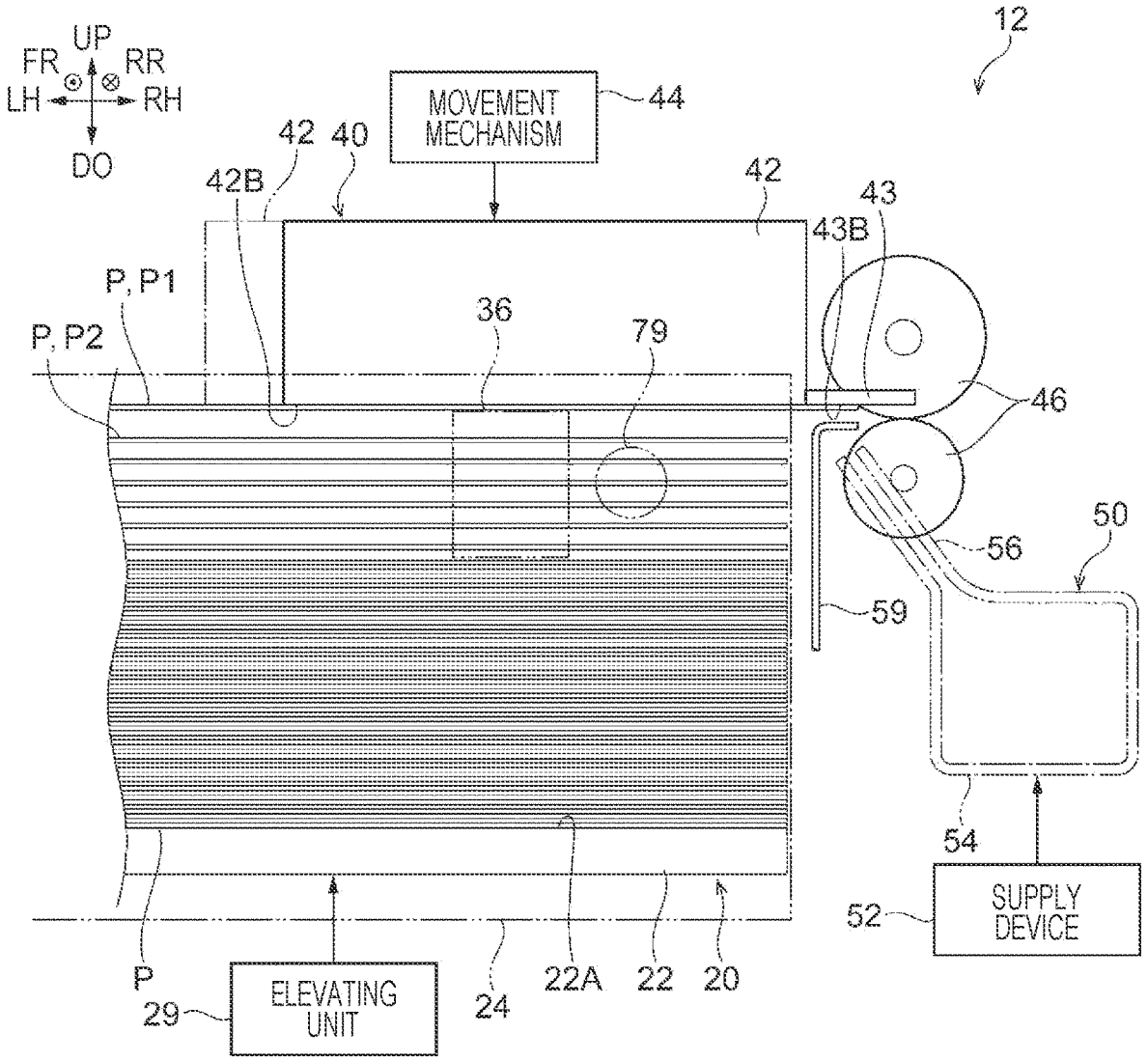
FIG. 5 is a schematic view illustrating a state in which an adsorption body has moved to a pass and receive position in the feeding device illustrated in FIG. 4.

The supply unit 30 illustrated in FIG. 3 is a component unit that supplies air into space between multiple loaded recording media P to float them. The supply unit 30 supplies air to multiple recording media P located in a predetermined range including the uppermost recording medium P among the multiple recording media P loaded on the loading unit 22. In other words, the supply unit 30 supplies air to multiple recording media P loaded on the loading unit 22, in a range from the feed height to a predetermined position on the lower side. The reason why the supply unit 30 supplies air to multiple loaded recording media P to float them is because the multiple recording media P are separated and fed one by one by supplying air into space between the multiple recording media P. FIGS. 2, 4, and 5 schematically illustrate a state in which air is supplied to an upper-side part of the multiple loaded recording media P to float them.

In the exemplary embodiment, as illustrated in FIG. 3, the supply unit 30 has a pair of air blowers 32, a pair of flow tubes 34, and a pair of supply ports 36.

The pair of air blowers 32 is a component unit that blows wind (in other words, air). The pair of air blowers 32 are mounted on the respective outer surfaces (in other words, the surfaces on opposite sides of surfaces opposed to the recording media P loaded on the loading unit 22) of the pair of side walls 24. As the air blowers 32, for example, a centrifugal fan, such as a multi-blade blower (for example, a sirocco fan), which blows air in a centrifugal direction is used. As the air blowers 32, an axial air blower that blows air in an axial direction, or another air blower may be used.

Each of the pair of flow tubes 34 forms a path through which air sent from a corresponding one of the pair of air blowers 32 flows. Each of the pair of flow tubes 34 is connected to a corresponding one of the pair of air blowers 32 at one end, and is connected to a corresponding one of the pair of supply ports 36 at the other end.

Each of the pair of supply ports 36 is a port for supplying air to the multiple recording media P loaded on the loading unit 22, and is formed in each of the pair of side walls 24. Each of the pair of supply ports 36 is open on the front-end side of the multiple recording media P loaded on the loading unit 22, and in an upper portion of the side walls 24.

The supply unit 30 supplies, from the pair of air blowers 32, air into space between the multiple recording media P loaded on the loading unit 22 from both lateral-end sides (in other words, the front side and the rear side) through the pair of flow tubes 34 and the pair of supply ports 36.

A supply direction modifier 38 is a component unit that modifies the supply direction of air into space between the multiple loaded recording media P. Specifically, the supply direction modifier 38 is comprised of a louver having, for example, multiple wing plates provided in each supply port 36. The supply direction modifier 38 is able to change the supply direction of air in at least one of the upward-downward direction and the rightward-leftward direction, for example. The supply direction modifier 38 is not limited to a louver, and another modifying device may be used.

A supply region modifier 39 is a component unit that modifies a supply region of air into space between the multiple loaded recording media P. Specifically, the supply region modifier 39 is comprised of an opening and closing plate (in other words, a shutter) that is movably provided, for example, in the supply ports 36, and can modify through its movement at least one of an opening position and an opening area of the supply port 36. The supply region modifier 39 is able to change the supply region of air in at least one of the upward-downward direction and the rightward-leftward direction, for example. The supply region modifier 39 is not limited to an opening and closing plate, and another modifying device may be used.

The supply unit 30 supplies air into space between the multiple recording media P loaded on the loading unit 22 from both lateral-end sides (in other words, the front side and the rear side), however, the configuration is not limited thereto. The supply unit 30 may supply air into space between the multiple recording media P loaded on the loading unit 22 from one (in other words, one of the front side and the rear side) of both lateral ends. Alternatively, the supply unit 30 may be configured to supply air into space between the multiple loaded recording media P from at least one of the front end and the rear end of the recording media P in replacement of or in addition to supply of air from at least one of both lateral ends of the recording media P. Therefore, the supply unit 30 may be configured to supply air into space between the multiple loaded recording media P from at least one of both lateral ends, the front end and the rear end.

(Feeder 40)

The feeder 40 illustrated in FIGS. 2, 4 and 5 is a component unit that adsorbs a recording medium P floated by the supply unit 30 and feeds the recording medium P. Specifically, as illustrated in FIG. 4, the feeder 40 adsorbs the uppermost recording medium P (hereinafter referred to as the uppermost medium P1) among the recording media P floated by the supply unit 30, and feeds the uppermost medium P1 downstream (specifically, the rightward direction) in the feed direction as illustrated in FIG. 5. More specifically, as illustrated in FIGS. 4 and 5, the feeder 40 has an adsorption body 42, a movement mechanism 44, and a pair of feed rollers 46.

The adsorption body 42 is a component unit that causes a lower surface 42B to adsorb the uppermost medium P1 by adsorption. Specifically, the adsorption body 42 adsorbs the uppermost medium P1 at a position rearward of the front end of the uppermost medium P1 located at the feed height. In the adsorption body 42, an extending section 43 is formed which extends downstream (specifically, the rightward direction) in the feed direction. The uppermost medium P1 is adsorbed by the lower surface 42B of the adsorption body 42, thereby causing the front end of the uppermost medium P1 to be pressed against the lower surface 43B of the extending section 43. The lower surface 42B of the adsorption body 42 is an example of an adsorption surface.

The movement mechanism 44 is a mechanism that moves the adsorption body 42 in the rightward-leftward direction (in other words, the downstream direction and the upstream direction in the feed direction) between a suction position (the position indicated in FIG. 2, and the position indicated by a dashed-two dotted line in FIG. 5) and a pass and receive position (the position indicated by a solid line in FIG. 5).

Specifically, the movement mechanism 44 is constructed using a publicly known mechanism such as a motor, a gear, a rack, a pinion and a belt drive. Note that the movement mechanism 44 is not limited to a specific mechanism, and it is possible to use various configurations.

The pair of feed rollers 46 provide a feed member that feeds a recording medium P to the image former 16. The pair of feed rollers 46 are disposed downstream (specifically, at the above-mentioned pass and receive position) in the feed direction with respect to the adsorption body 42 so as to be in contact with each other in the upward-downward direction. Note that the feed member is not limited to the pair of feed rollers 46. The feed member may be a feed member such as an annular belt or a drum, and it is possible to use various feed members.

In the feeder 40, the adsorption body 42 causes the lower surface 42B to adsorb the uppermost medium P1 by suction at the suction position (the position indicated in FIG. 2), and the adsorption body 42 is moved to the pass and receive position (the position indicated by a solid line in FIG. 5) by the movement mechanism 44. The recording medium P is passed at the pass and receive position from the adsorption body 42 to the pair of feed rollers 46, which feed the recording medium P to the image former 16.

Note that the feeder 40 is not limited to the above-mentioned configuration. For example, in replacement of the adsorption body 42, the feeder 40 may adopt a configuration using a feed member such as a belt. In a configuration using an annular belt, for example, a suction unit may be provided on the inner periphery of the belt, the suction unit causing the outer peripheral surface of the belt to adsorb a recording medium P by suction.

(Separator 50 and Restrictor 59)

The separator 50 illustrated in FIG. 4 is a component unit that supplies air to the recording medium P (hereinafter referred to as the subsequent medium P2) placed immediately below the uppermost medium P1 adsorbed by the feeder 40 (specifically, the adsorption body 42) to separate the subsequent medium P2 from the uppermost medium P1. The uppermost medium P1 is an example of a first medium. The subsequent medium P2 is an example of a second medium. The subsequent medium P2 is the recording medium P to be fed subsequent to the uppermost medium P1, that is, the recording medium P disposed adjacent to and below the uppermost medium P1. Specifically, as illustrated in FIG. 4, the separator 50 has, for example, a supply device 52, a flow tube 54, and a nozzle 56.

The supply device 52 is a device that supplies air to the flow tube 54. Specifically, as the supply device 52, for example, an air compressor that supplies pressurized air to the flow tube 54 is used. The supply device 52 is not limited to an air compressor, and another supply device may be used.

The flow tube 54 forms a path through which the air sent by the supply device 52 flows. The flow tube 54 extends in a width direction (that is, the forward-rearward direction) of the recording media P, and allows air to flow in the width direction.

Multiple nozzles 56 are provided in the width direction (that is, the forward-rearward direction) of the recording media P with respect to the flow tube 54. Each of the multiple nozzles 56 extends from the flow tube 54 to the adsorption body 42 (specifically, the extending section 43) side (in other words, diagonal upper left side).

In the separator 50, the adsorption body 42 located at the suction position (the position illustrated in FIG. 2) discharges air to the extending section 43 through the nozzle 56 from a position downstream in the feed direction. The air hitting the extending section 43 is supplied between the uppermost medium P1 and the subsequent medium P2. Thus, the subsequent medium P2 is separated from the uppermost medium P1, and the subsequent medium P2 falls.

In this manner, the air through the nozzle 56 is supplied between the uppermost medium P1 and the subsequent medium P2 through the extending section 43, thus the extending section 43 may be regarded as an element of the separator 50. The separator 50 may be configured to directly supply air into space between the uppermost medium P1 and the subsequent medium P2 not through the extending section 43.

The restrictor 59 illustrated in FIG. 4 is a component unit that restricts the movement of the subsequent medium P2 downstream in the feed direction. Specifically, the restrictor 59 is comprised of a restriction wall disposed between the storage 20 and the pair of feed rollers 46 (specifically, the feed roller 46 disposed on the lower side) in a side view. The restrictor 59 is formed in a plate shape extending in the upward-downward direction in a side view.

The restrictor 59 comes into contact with the subsequent medium P2 fed downstream in the feed direction along with the uppermost medium P1 due to movement of the adsorption body 42 to the pass and receive position, thereby causing the subsequent medium P2 to fall from the uppermost medium P1 to restrict the movement of the subsequent medium P2 downstream in the feed direction. Note that the restrictor 59 is not limited to the above-mentioned configuration, and another restriction device may be used.

(Detector 70)

The detector 70 illustrated in FIG. 3 is a component unit that detects the position of at least one of the uppermost medium P1 and the subsequent medium P2 after air is supplied from the separator 50. In the exemplary embodiment, the detector 70 detects both the position of the uppermost medium P1 and the position of the subsequent medium P2 after air is supplied by the separator 50.

Specifically, the detector 70 detects, as the position of the uppermost medium P1, a distance 90 (see FIG. 6) between the lower surface 42B as the adsorption surface of the recording medium P in the feeder 40 and the front end of the uppermost medium P1. Note that the distance 90 is a distance in the load direction (specifically, in the upward-downward direction) of the recording media P.

In addition, the detector 70 detects, as the position of the subsequent medium P2, a height 92 (see FIG. 6) of the subsequent medium P2 relative to the reference height. The reference height is the height of the upper edge of the restrictor 59. The height 92 is a dimension in the load direction (specifically, the upward-downward direction) of the recording media P.

Figure 6:
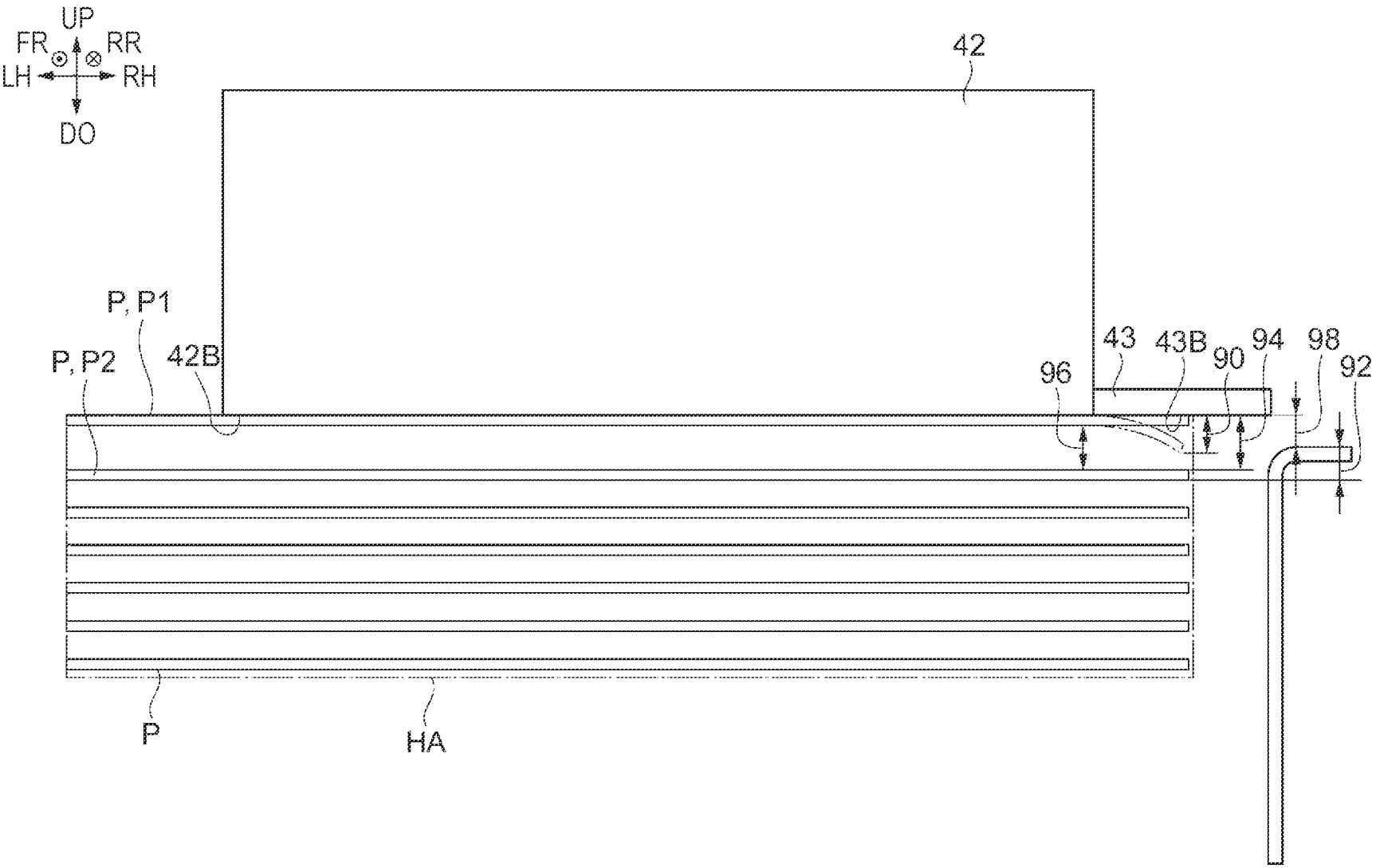
FIG. 6 is a schematic view illustrating an image capture range of an image capture unit according to the exemplary embodiment.

Specifically, the detector 70 detects, as the position of the subsequent medium P2, an interval between the lower surface 42B as the adsorption surface of the recording medium P in the feeder 40 or the uppermost medium P1, and the subsequent medium P2. The interval is an interval in the load direction (specifically, the upward-downward direction) of the recording media P. An interval 94 illustrated in FIG. 6 is the interval between the lower surface 42B and the subsequent medium P2, and an interval 96 illustrated in FIG. 6 is the interval between the uppermost medium P1 and the subsequent medium P2.

In the exemplary embodiment, as illustrated in FIG. 3, the detector 70 has an image capture unit 72 and a decision device 60.

The image capture unit 72 is a component unit that captures the images of multiple recording media P after being floated by the supply unit 30 and air being supplied by the separator 50. Specifically, the image capture unit 72 is comprised of a camera including, for example, an optical element such as a lens, and an image capture device such as a complementary metal oxide semiconductor (CMOS) image sensor. The image capture unit 72 is not limited to the above-mentioned camera, and may be a camera including a charge coupled device (CCD) or another device as an image capture device, and another image capture unit may be used.

The image capture unit 72 is mounted on the outer surface of one of the pair of side walls 24 (for example, the side wall 24 on the front side). The image capture unit 72 captures the images of multiple recording media P in a floating state from one side (specifically, the front side) in the width direction through an opening 79 formed in the side wall 24. As illustrated in FIG. 6, the image capture unit 72 has an image capture range (specifically, the range indicated by a dashed-dotted line HA in FIG. 6) for capturing the front-end part of the multiple recording media P in a floating state.

The image capture unit 72 continues an image capture operation in the image capture range while a feeding operation for the recording medium P is continued by the feeder 40. The image capture unit 72 captures the images of recording media P continuously for multiple times.

The image capture unit 72 has an illumination unit (not illustrated) that illuminates the image capture range. In the exemplary embodiment, the image capture unit 72 captures the images of multiple recording media P from one side (specifically, the front side) in the width direction, however, the configuration is not limited thereto. For example, the image capture unit 72 may be configured to capture the images of multiple recording media P from the other side (specifically, the rear side) in the width direction. Alternatively, the image capture unit 72 may be configured to capture the images of multiple recording media P from a downstream side (specifically, the rightward side) or an upstream side (specifically, the leftward side).

Figure 7:
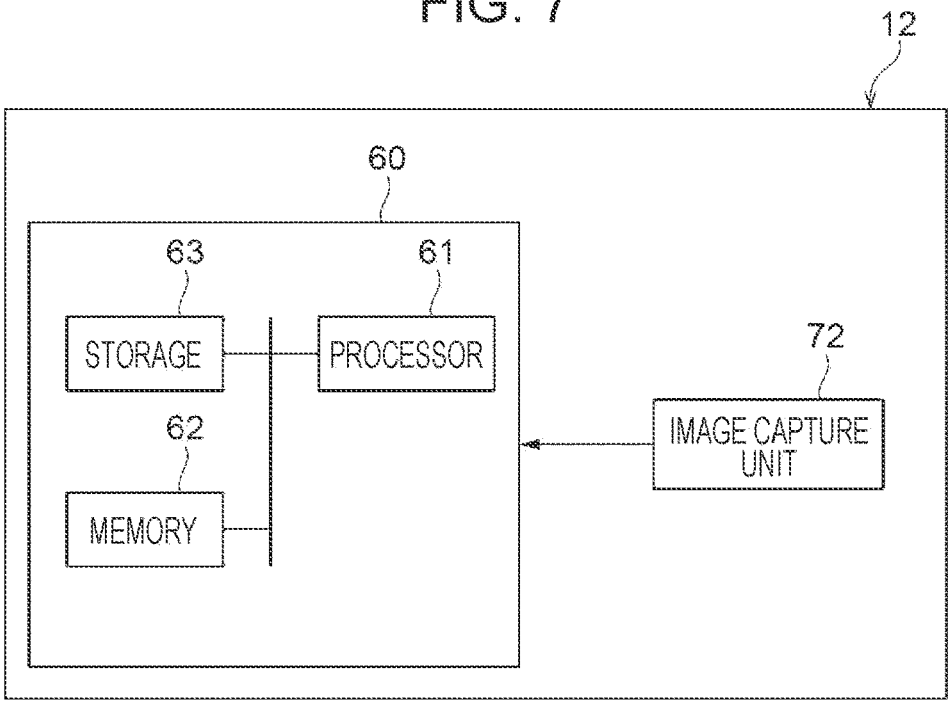
FIG. 7 is a block diagram illustrating an example of a decision device in the feeding device according to the exemplary embodiment.

The decision device 60 illustrated in FIGS. 3 and 7 is a device that makes various types of decision (including determination) in the feeding device 12. Specifically, as illustrated in FIG. 7, the decision device 60 has a processor 61, a memory 62, and a storage 63.

As the processor 61, for example, a central processing unit (CPU), which is a general-purpose processor, is used. The storage 63 stores various programs including an execution program 63A (see FIG. 8), and various types of data. Specifically, the storage 63 is implemented by a recording device, such as a hard disk drive (HDD), a solid state drive (SSD) and a flash memory.

The memory 62 provides a work area for the processor 61 to execute various programs, and temporarily stores various programs or various data when the processor 61 executes processing. The processor 61 reads various programs including the execution program 63A from the storage 63 into the memory 62, and executes the programs using the memory 62 as a work area.

Figure 8:
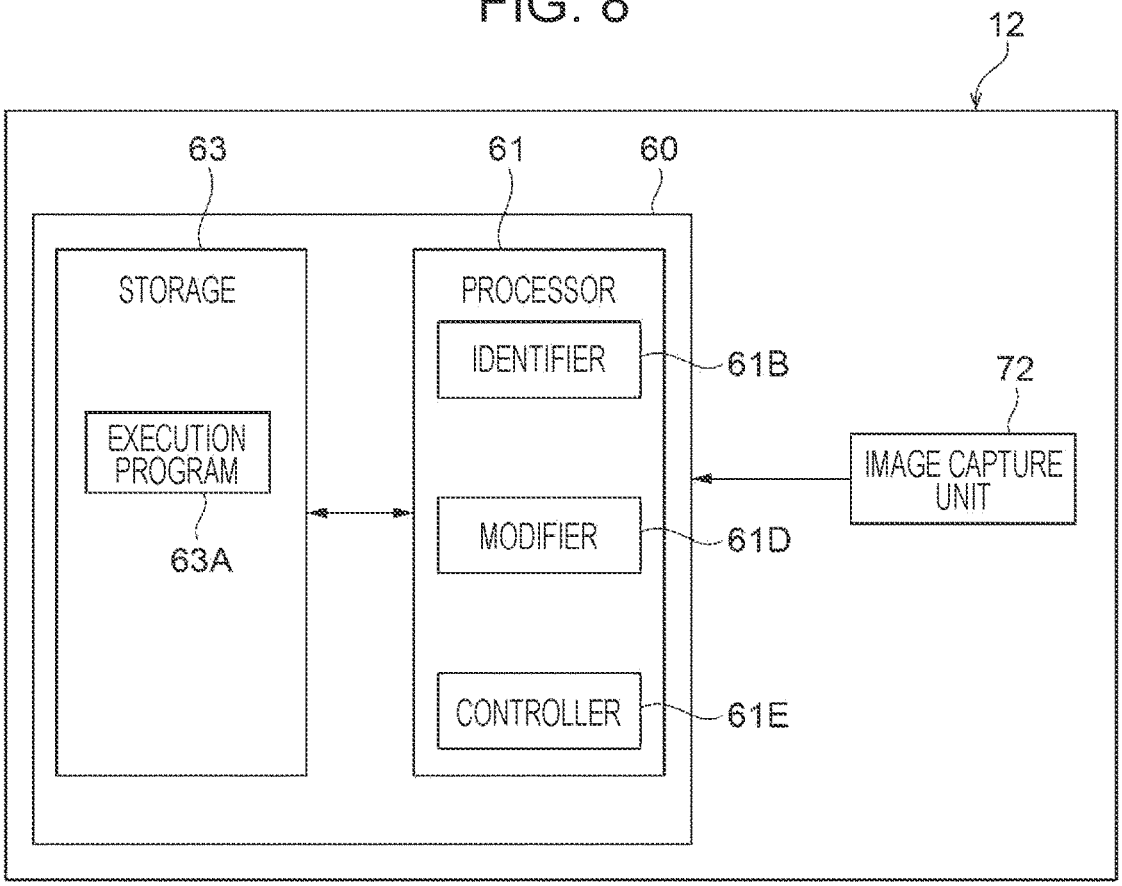
FIG. 8 is a block diagram illustrating an example of a functional configuration of a processor of the decision device in the feeding device according to the exemplary embodiment.

In the decision device 60, the processor 61 implements various functions by executing the execution program 63A. Hereinafter, the functional configuration implemented by the cooperation between the processor 61 as a hardware resource and the execution program 63A as a software resource will be described. FIG. 8 is a block diagram illustrating the functional configuration of the processor 61.

As illustrated in FIG. 8, in the decision device 60, the processor 61 functions as an identifier 61B, a modifier 61D, and a controller 61E by executing the execution program 63A.

The identifier 61B identifies both the position of the uppermost medium P1 and the position of the subsequent medium P2 based on the images captured by the image capture unit 72 after air is supplied by the separator 50. Specifically, the identifier 61B identifies, as the position of the uppermost medium P1, the distance 90 (see FIG. 6) between the lower surface 42B of the adsorption body 42 and the front end of the uppermost medium P1 based on the images. In addition, the identifier 61B identifies, as the position of the subsequent medium P2, the height 92 (see FIG. 6) of the subsequent medium P2 relative to the upper edge of the restrictor 59 based on the images. Furthermore, the identifier 61B identifies, as the position of the subsequent medium P2, the interval between the lower surface 42B of the adsorption body 42 or the uppermost medium P1, and the subsequent medium P2 based on the images.

The identifier 61B extracts, as an image of the recording medium P, a portion of an image captured by the image capture unit 72, the portion having characteristics (for example, a color including light and dark) as the image of the recording medium P, and identifies the position of the uppermost medium P1 and the position of the subsequent medium P2. In this manner, the identifier 61B identifies the position of the uppermost medium P1 and the position of the subsequent medium P2, thereby detecting the positions by the detector 70.

The modifier 61D modifies the conditions related to the feeding operation of the feeder 40 based on the positions detected by the detector 70. Specifically, the modifier 61D modifies the conditions related to the feeding operation of the feeder 40 based on the position of the uppermost medium P1 and the position of the subsequent medium P2 identified by the identifier 61B.

In the exemplary embodiment, when the interval between the lower surface 42B of the adsorption body 42 or the uppermost medium P1, and the subsequent medium P2 is less than a predetermined threshold, the modifier 61D modifies the conditions. When the interval exceeds the predetermined threshold, the modifier 61D does not modify the conditions. The predetermined threshold is an interval 98 (see FIG. 6) between the lower surface 42B of the adsorption body 42 and the restrictor 59. In other words, when the subsequent medium P2 is located on the upper side of the restrictor 59, the modifier 61D modifies the conditions because there is a possibility of double feeding of the uppermost medium P1 and the subsequent medium P2.

In addition, when the height of the subsequent medium P2 is higher than the reference height (specifically, the height of the upper edge of the restrictor 59), the modifier 61D modifies the conditions, and when the height of the subsequent medium P2 is lower than or equal to the reference height, the modifier 61D does not modify the conditions. In other words, when the subsequent medium P2 is located on the upper side of the restrictor 59, the modifier 61D modifies the conditions because there is a possibility of double feeding of the uppermost medium P1 and the subsequent medium P2.

When the distance 90 (see FIG. 6) between the lower surface 42B of the adsorption body 42 and the front end of the uppermost medium P1 exceeds a predetermined threshold, the modifier 61D modifies the conditions, and when the distance 90 (see FIG. 6) is less than or equal to the predetermined threshold, the modifier 61D does not modify the conditions. In other words, when the front end of the uppermost medium P1 is away from the lower surface 42B of the adsorption body 42 with the predetermined threshold exceeded, the modifier 61D modifies the conditions because there is a possibility of a feed failure in the uppermost medium P1.

The conditions include the volume, temperature, humidity, supply direction and supply region of the air supplied to space between multiple recording media P in the supply unit 30. In addition, the conditions include the volume, temperature, humidity, supply direction and supply region of the air supplied to the subsequent medium P2 in the separator 50. Furthermore, the conditions include the position of the restrictor 59 in the upward-downward direction. In addition, the conditions include the height of feeding by the elevating unit 29. Furthermore, the conditions include the feeding distance set by the adsorption body 42, in other words, the suction position (the position illustrated in FIG. 2) of the adsorption body 42 and the pass and receive position (the position indicated by a solid line in FIG. 5).

The controller 61E controls the operation of each unit of the feeding device 12 based on the conditions modified by the modifier 61D. In this manner, the decision device 60 has a function of controlling the operation of each unit of the feeding device 12, thus may be called a control device.

In the exemplary embodiment, of the functional units of the identifier 61B, the modifier 61D, and the controller 61E, the identifier 61B implements the functional unit of the detector 70. For example, the modifier 61D, and the controller 61E may be comprised of a device other than the decision device 60. Furthermore, the identifier 61B, the modifier 61D, and the controller 61E may be comprised of separate devices.

The detector 70 is not limited to the above-mentioned configuration. For example, in replacement of the image capture unit 72, the detector 70 may have a radiation unit that radiates vertically extending strip-shaped light to multiple recording media P, and a light reception unit that receives light, so that the position of at least one of the uppermost medium P1 and the subsequent medium P2 is detected based on the height of a portion where the light is shielded by the recording media P. Furthermore, in a configuration having the radiation unit and the light reception unit, the position may be detected based on the height of a portion where the light is reflected or absorbed by the recording medium P. As the radiation unit, for example, a light emission unit may be used, in which light emitting devices are disposed in the upward-downward direction in a row or staggered manner, or are disposed in two-dimensional form. As the light reception unit, a light receiving unit may be used, in which for example, light receiving devices are disposed in the upward-downward direction in a row or staggered manner, or are disposed in two-dimensional form. The above-mentioned detector having the radiation unit and the light reception unit may be called a detector that does not capture an image of multiple recording media P.

In the exemplary embodiment, the detector 70 detects both the position of the uppermost medium P1 and the position of the subsequent medium P2 after air is supplied by the separator 50, however, the configuration is not limited thereto. The detector 70 may be configured to detect one of the position of the uppermost medium P1 and the position of the subsequent medium P2 after air is supplied by the separator 50.

Specifically, the detector 70 detects the distance 90 (see FIG. 6) between the lower surface 42B of the adsorption body 42 and the front end of the uppermost medium P1, the height 92 (see FIG. 6) of the subsequent medium P2 relative to the reference height, and the interval between the lower surface 42B of the adsorption body 42 or the uppermost medium P1, and the subsequent medium P2, however, the configuration is not limited thereto. The detector 70 may be configured to detect one of the distance 90, the height 92, and the interval.

Effects According to Exemplary Embodiment

Next, the effects according to the exemplary embodiment will be described.

In the exemplary embodiment, the detector 70 detects the position of at least one of the uppermost medium P1 and the subsequent medium P2 after air is supplied by the separator 50.

In the case (hereinafter referred to as case A) where the detector 70 detects the position of at least one of the uppermost medium P1 and the subsequent medium P2 before air is supplied by the separator 50, the position may vary due to the supply of air by the separator 50, and the detected position may differ from the actual position.

In contrast, in the exemplary embodiment, as described above, the detector 70 detects the position of at least one of the uppermost medium P1 and the subsequent medium P2 after air is supplied by the separator 50, thus the accuracy in detecting the position is higher than in the case A.

As a result, the modifier modifies the conditions related to feeding operation based on the results of detection with high accuracy, thus the occurrence of a feed failure in at least one of the uppermost medium P1 and the subsequent medium P2 is reduced than in the case A. Therefore, in the image forming apparatus 10, an image can be formed on the recording medium P while reducing the occurrence of a feed failure in at least one of the uppermost medium P1 and the subsequent medium P2 than in the case A.

In the exemplary embodiment, the image capture unit 72 captures an image of multiple recording media P floated by the supply unit 30 after air is supplied by the separator 50, and the identifier 61B identifies the position of the uppermost medium P1 and the position of the subsequent medium P2 based on the image captured by the image capture unit 72.

Here, the position and posture of the uppermost medium P1 is changed depending on whether the uppermost medium P1 is appropriately adsorbed by the feeder 40, and the position and posture of the subsequent medium P2 is changed depending on whether the subsequent medium P2 is appropriately separated from the uppermost medium P1. Thus, in the case (hereinafter referred to as case B) where the position of at least one of the uppermost medium P1 and the subsequent medium P2 is detected using a sensor which does not capture an image of multiple recording media P, a detection failure may occur.

In contrast, in the exemplary embodiment, as described above, the identifier 61B identifies the position of the uppermost medium P1, and the position of the subsequent medium P2 based on the image captured by the image capture unit 72, thus the detection accuracy is higher than in the case B.

In the exemplary embodiment, the detector 70 detects, as the position of the subsequent medium P2, the interval between the lower surface 42B of the adsorption body 42 or the uppermost medium P1, and the subsequent medium P2. Thus, the modifier 61D can modify the conditions related to the feeding operation of the feeder 40 based on the interval between the lower surface 42B of the adsorption body 42 or the uppermost medium P1, and the subsequent medium P2.

In the exemplary embodiment, when the interval between the lower surface 42B of the adsorption body 42 or the uppermost medium P1, and the subsequent medium P2 is less than a predetermined threshold, the modifier 61D modifies the conditions, and when the interval exceeds the predetermined threshold, the modifier 61D does not modify the conditions.

Here, in the case (hereinafter referred to as case C) where the modifier 61D always modifies the conditions based on the interval between the lower surface 42B of the adsorption body 42 or the uppermost medium P1, and the subsequent medium P2, when the feeding operation of the feeder 40 is performed, a modification process of modifying the conditions needs to be executed, thus, the number of processes increases.

In contrast, in the exemplary embodiment, the conditions are not modified when the interval exceeds a predetermined threshold, thus, the number of processes when performing the feeding operation of the feeder 40 is reduced than in the case C.

In the exemplary embodiment, the threshold is the interval between the lower surface 42B of the adsorption body 42 and the restrictor 59.

Here, in the case (hereinafter referred to as case D) where the threshold is the interval between the lower surface 42B of the adsorption body 42 and the restrictor 59, when the subsequent medium P2 adheres to the uppermost medium P1 adsorbed by the lower surface 42B of the adsorption body 42, and the subsequent medium P2 is located on the upper side of the restrictor 59, double feeding of the uppermost medium P1 and the subsequent medium P2 may occur without restricting the movement of the subsequent medium P2 by the restrictor 59.

In contrast, in the exemplary embodiment, the threshold is less than the interval between the lower surface 42B of the adsorption body 42 and the restrictor 59, thus the occurrence of double feeding of the uppermost medium P1 and the subsequent medium P2 is reduced than in the case D.

In the exemplary embodiment, the detector 70 detects, as the position of the subsequent medium P2, the height 92 (see FIG. 6) of the subsequent medium P2 relative to the reference height. Thus, the modifier 61D can modify the conditions related to the feeding operation of the feeder 40 based on the height 92 (see FIG. 6) of the subsequent medium P2 relative to the reference height.

In the exemplary embodiment, when the height of the subsequent medium P2 is higher than the reference height, the modifier 61D modifies the conditions, and when the height of the subsequent medium P2 is lower than or equal to the reference height, the modifier 61D does not modify the conditions.

Here, in the case (hereinafter referred to as case E) where the modifier 61D always modifies the conditions based on the height 92 (see FIG. 6) of the subsequent medium P2 relative to the reference height, when the feeding operation of the feeder 40 is performed, a modification process of modifying the conditions needs to be executed, thus, the number of processes increases.

In contrast, in the exemplary embodiment, the modifier 61D does not modify the conditions when the height of the subsequent medium P2 is lower than or equal to the reference height, thus, the number of processes when performing the feeding operation of the feeder 40 is reduced than in the case E.

In the exemplary embodiment, the reference height is the height of the upper edge of the restrictor 59. Here, in the case (hereinafter referred to as case F) where the reference height is higher than the height of the upper edge of the restrictor 59, when the subsequent medium P2 adheres to the uppermost medium P1 adsorbed by the lower surface 42B of the adsorption body 42, and the subsequent medium P2 is located on the upper side of the restrictor 59, double feeding of the uppermost medium P1 and the subsequent medium P2 may occur without restricting the movement of the subsequent medium P2 by the restrictor 59.

In contrast, in the exemplary embodiment, the reference height is the height of the upper edge of the restrictor 59, thus the occurrence of double feeding of the uppermost medium P1 and the subsequent medium P2 is reduced than in the case F.

In the exemplary embodiment, the detector 70 detects, as the position of the uppermost medium P1, the distance 90 (see FIG. 6) between the lower surface 42B of the adsorption body 42 and the front end of the uppermost medium P1. Thus, the modifier 61D can modify the conditions related to the feeding operation of the feeder 40 based on the height 92 (see FIG. 6) of the subsequent medium P2 relative to the reference height.

In the exemplary embodiment, when the distance 90 (see FIG. 6) between the lower surface 42B of the adsorption body 42 and the front end of the uppermost medium P1 exceeds a predetermined threshold, the modifier 61D modifies the conditions, and when the distance 90 (see FIG. 6) is less than or equal to the predetermined threshold, the modifier 61D does not modify the conditions.

Here, in the case (hereinafter referred to as case G) where the modifier 61D always modifies the conditions based on the distance 90 (see FIG. 6) between the lower surface 42B of the adsorption body 42 and the front end of the uppermost medium P1, when the feeding operation of the feeder 40 is performed, a modification process of modifying the conditions needs to be executed, thus, the number of processes increases.

In contrast, in the exemplary embodiment, the modifier 61D does not modify the conditions when the distance 90 (see FIG. 6) between the lower surface 42B of the adsorption body 42 and the front end of the uppermost medium P1 is less than or equal to the predetermined threshold, thus, the number of processes when performing the feeding operation of the feeder 40 is reduced than in the case G.

(Modifications)

In the exemplary embodiment, when the interval between the lower surface 42B of the adsorption body 42 or the uppermost medium P1, and the subsequent medium P2 is less than a predetermined threshold, the modifier 61D modifies the conditions, and when the interval exceeds the predetermined threshold, the modifier 61D does not modify the conditions, however, the configuration is not limited thereto. For example, the modifier 61D may be configured to modify the conditions always based on the interval between the lower surface 42B of the adsorption body 42 or the uppermost medium P1, and the subsequent medium P2.

In the exemplary embodiment, the threshold is the interval between the lower surface 42B of the adsorption body 42 and the restrictor 59, however, the configuration is not limited thereto. The threshold may be less than the interval between the lower surface 42B of the adsorption body 42 and the restrictor 59.

In the exemplary embodiment, when the height of the subsequent medium P2 is higher than the reference height, the modifier 61D modifies the conditions, and when the height of the subsequent medium P2 is lower than or equal to the reference height, the modifier 61D does not modify the conditions, however, the configuration is not limited thereto. For example, the modifier 61D may be configured to modify the conditions always based on the height 92 (see FIG. 6) of the subsequent medium P2 relative to the reference height.

In the exemplary embodiment, the reference height is the height of the upper edge of the restrictor 59, however, the configuration is not limited thereto. For example, the reference height may be higher than the height of the upper edge of the restrictor 59.

In the exemplary embodiment, when the distance 90 (see FIG. 6) between the lower surface 42B of the adsorption body 42 and the front end of the uppermost medium P1 exceeds a predetermined threshold, the modifier 61D modifies the conditions, and when the distance 90 (see FIG. 6) is less than or equal to the predetermined threshold, the modifier 61D does not modify the conditions, however, the configuration is not limited thereto. For example, the modifier 61D may be configured to modify the conditions always based on the distance 90 (see FIG. 6) between the lower surface 42B of the adsorption body 42 and the front end of the uppermost medium P1.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A feeding device comprising:

a supply that supplies air into space between a plurality of media loaded to float the media;

a feeder that adsorbs the media floated by the supply and feeds the media;

a separator that supplies air to a second medium disposed immediately below a first medium adsorbed by the feeder to separate the second medium from the first medium;

a restrictor that restricts movement of the second medium downstream in a feed direction;

a detector that detects a height of the second medium relative to a height of the restrictor after air is supplied by the separator; and a processor configured to modify a condition related to a feeding operation of the feeder based a position detected by the detector.

2. The feeding device according to claim 1, wherein the detector includes:

camera configured to capture an image of a plurality of media floated by the supply after air is supplied by the separator; and the processor is configured to identify the position based on the image.

3. The feeding device according to claim 1, wherein when the height of the second medium is higher than the height of the restrictor, the processor is configured to modify the condition related to the feeding operation of the feeder, and when the height of the second medium is lower than or equal to the height of the restrictor, the processor is configured to not modify the condition related to the feeding operation of the feeder.

4. The feeding device according to claim 3, further comprising:

wherein the height of the restrictor is a height of an upper edge of the restrictor.

5. An image forming apparatus comprising:

the feeding device according to claim 1; and an image former that forms an image on a medium fed from the feeding device.

* * * * *